United States Patent [19]

Takizawa

[11] Patent Number: 4,563,568

[45] Date of Patent: Jan. 7, 1986

[54] DIESEL ENGINE GLOW PLUG

[75] Inventor: Tozo Takizawa, Saitama, Japan

[73] Assignee: Jidosha Kiki Co., Ltd., Tokyo, Japan

[21] Appl. No.: 673,371

[22] Filed: Nov. 20, 1984

[30] Foreign Application Priority Data

Nov. 28, 1983 [JP] Japan ..... 58-222151

[51] Int. Cl.[4] ..... F23Q 7/22

[52] U.S. Cl. ..... 219/270; 123/145 A; 219/267; 219/541; 219/544; 361/266

[58] Field of Search ..... 123/145 R, 145 A, 184, 123/272; 219/260, 267, 270, 523, 541, 544, 553; 338/303; 361/264, 265, 266; 428/295; 431/262

[56] References Cited

U.S. PATENT DOCUMENTS

| | | | |
|---|---|---|---|
| 2,030,937 | 2/1936 | Reichmann | 219/270 X |
| 4,357,526 | 11/1982 | Yamamoto et al. | 219/544 |
| 4,401,065 | 8/1983 | Minegishi et al. | 123/145 A |
| 4,426,568 | 1/1984 | Kato et al. | 219/270 |
| 4,458,637 | 7/1984 | Minegishi et al. | 123/145 A |
| 4,499,366 | 2/1985 | Yoshida et al. | 219/270 |
| 4,502,430 | 3/1985 | Yokoi et al. | 219/270 X |

FOREIGN PATENT DOCUMENTS

| | | |
|---|---|---|
| 1714197 | 7/1952 | Fed. Rep. of Germany . |
| 58-210412 | 7/1983 | Japan . |

*Primary Examiner*—Volodymyr Y. Mayewsky
*Attorney, Agent, or Firm*—Blakely Sokoloff Taylor & Zafman

[57] ABSTRACT

A glow plug for preheating the combustion chamber of a diesel engine. The glow plug has a ceramic heater rod with an embedded resistor. A metal holder holds the front of the heater rod. A terminal assembly at the rear of the holder provides for two electrically isolated terminals which are connected to the heater rod by flexible, insulated wires. The insulating bush which isolates the terminals is formed by inserting insulating material between a metal pipe and the terminals. This pipe is then subject to external force to create an air-tight seal.

6 Claims, 7 Drawing Figures

DIESEL ENGINE GLOW PLUG

BACKGROUND OF THE INVENTION

The present invention relates to a glow plug for preheating a precombustion chamber or a combustion chamber of a diesel engine and, more particularly, to a two-wire type glow plug having two terminals which are insulated from an engine body.

Since the start-up of diesel engines is generally very difficult at low temperatures, a glow plug is arranged in a precombustion chamber or a combustion chamber. A current flows through the glow plug to heat intake air, or the glow plug is used as an ignition source, thereby improving performance during starting. A conventional glow plug comprises a heater plug called a sheath type glow plug wherein a coil is embedded in a heat-insulating metal sheath filled with a thermally and electrically insulating powder. However, indirect heating is employed in the sheath type glow plug, and it takes a long period of time to heat the engine to a predetermined temperature. The current flows through the coil and transfers heat from the coil to the sheath through the thermally and electrically insulating powder. The heat is then radiated from the sheath to the cylinder, resulting in low heat transfer efficiency. For the cylinder to be heated to a temperature of, for example, 800° C., it takes several tens of seconds.

When a current is increased in order to decrease the time required for heating, the coil may become disconnected, or the sheath may be damaged due to a high temperature. In addition, it is very complicated to embed the coil in the sheath with the thermally and electrically insulating powder.

Since the two terminals of the conventional sheath type glow plug are both electrically insulated from the engine body, the construction of the plug is complicated, and the assembly thereof becomes cumbersome, resulting in high cost. In addition, the size of the glow plug, especially, its diameter becomes large.

The two-wire type glow plug is used in an engine such as a marine engine or an engine using an AC power source when the plug cannot be grounded due to its specifications or other reasons. In this case, the sheath serving as one electrode of the coil must be insulated from the plug holder. The sheath leads from the electrode terminal block of the holder through a lead wire, thus increasing a radial size of the plug. Demand has arisen for a solution to these problems.

Another conventional ceramic heater glow plug designed so as to solve problem of the heat transfer efficiency of the conventional sheath glow plug has received a great deal of attention. In the ceramic heater type glow plug, a resistor is embedded in a ceramic material so as to constitute a heater rod which quickly heats the cylinder. However, an electrode terminal block of the heater rod and connections between an electrode terminal block of the holder and lead wires become complicated. Therefore, demand has arisen for a highly reliable compact glow plug having a simple construction, resulting in easy assembly and low cost.

SUMMARY OF THE INVENTION

It is, therefore, an object of the present invention to provide a diesel engine glow plug wherein molding and assembly can be easily performed at low cost.

It is another object of the present invention to provide a compact diesel engine glow plug wherein a radial size thereof can be decreased.

It is still another object of the present invention to provide a diesel engine glow plug with high reliability and high durability.

In order to achieve the above objects of the present invention, there is provided a diesel engine glow plug comprising:

a heater rod which has a resistor embedded therein and which is made of a ceramic;

a metal holder for holding the heater rod at a front end thereof; and a terminal assembly having first and second external connecting terminals which are held at a rear end portion of the holder and which are electrically insulated from each other, the rear end portion of the heater rod being provided with a pair of lead portions which are spaced apart by a predetermined distance from each other along a longitudinal direction of the heater rod and which are connected to two ends of the resistor, the lead portions being covered with terminal caps, respectively;

each of the terminal caps being connected to one end of a flexible insulator-covered wire the other end of which is connected to a corresponding one of the first and second external connecting terminals;

the second external connecting terminal being hollow;

the first external connecting terminal being housed in the second external connecting terminal through an insulating material;

the second external connecting terminal being housed in the rear end portion of the holder through an insulating bush; and the insulating bush being constituted by a metal pipe connected to the rear end portion of the holder and an insulating material inserted between the metal pipe and the second external connecting terminal;

whereby the metal pipe is subjected to an external force acting on the rear end portion of the holder so as to press the insulating materials on the first and second terminal connecting terminals in an air-tight manner.

DESCRIPTION OF THE PREFERRED EMBODIMENTS

Figure 1:
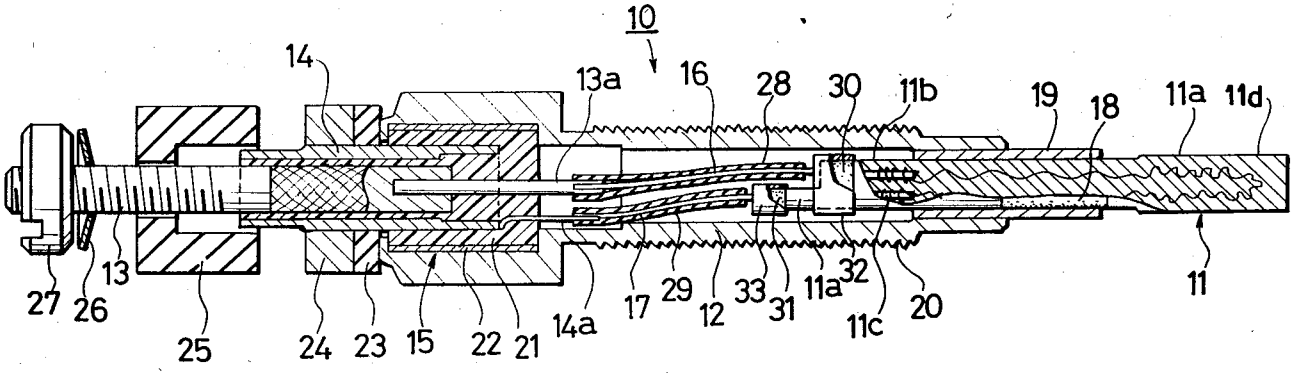
FIG. 1 is a longitudinal sectional view of a diesel engine glow plug according to an embodiment of the present invention.
Figure 2:
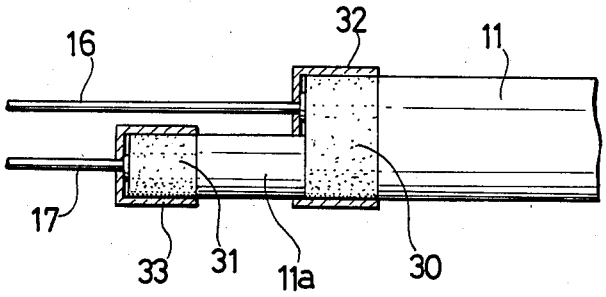
FIGS. 2 and 3 are respectively an enlarged sectional view and an enlarged perspective view showing the main part of the glow plug.
Figure 3:
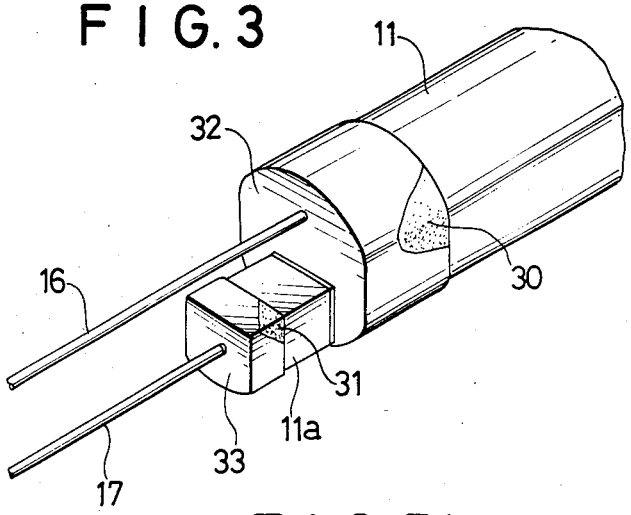

FIGS. 1 to 3 show a diesel engine glow plug according to an embodiment of the present invention. The overall construction of the glow plug will be described with reference to FIG. 1. A glow plug 10 comprises a heater rod 11 of an elliptical sectional shape (FIG. 3) and a metal holder 12 of a tubular shape. The heater rod 11 has a structure wherein a resistor 11*a* serving as a heater and a pair of lead portions 11*b* and 11*c* connected to two ends of the resistor 11*a* are embedded in a ceramic material 11*d*. The front end of the metal holder 12 holds the heater rod 11. A terminal assembly 15 is fitted in the rear end of the holder 12. The terminal assembly 15 has a structure wherein first and second external connecting terminals 13 and 14 are inserted through an insulating material such as a heat-resistant resin (e.g., epoxy resin or Bakelite). The terminals 13 and 14 are connected to the heater rod 11 through insulator-covered conductors 16 and 17 made of flexible wires.

A metallized layer 18 is formed on an outer surface of a central portion of the heater rod 11 along the longitudinal direction thereof. The metallized layer 18 is fitted in a reinforcing metal pipe 19 and is soldered therewith by a silver solder. The pipe 19 is also fixed by a silver solder at the front end of the holder 12. The metal pipe 19 has a through hole having a shape corresponding to a longitudinal section of the heater rod 11 so as to stably hold the heater rod 11. A male threaded portion 20 formed on the outer surface of the holder 12 is engaged in a female threaded portion formed in the engine body, thereby extending the distal end of the heater rod 11 inside the engine.

The terminal assembly 15 comprises a resin-molded assembly body 21 which integrally has a first external connecting terminal 13, a cylindrical second external connecting terminal 14, and an insulating layer for insulating the first external connecting terminal 13 from the second external connecting terminal 14. The first external connecting terminal 13 is located on the axis of the terminal assembly 15. A conductive rod portion 13*a* extends from the inner end of the first external connecting terminal 13 and is connected to the insulator-covered conductor 16. The second external connecting terminal 14 is positioned around the first external connecting terminal 13 and is spaced by a predetermined distance therefrom. A lead member 14*a* extends from part of the inner end of the terminal 14 and is connected to the conductor 17. A reinforcing metal pipe 22 covers the assembly body 21. The metal pipe 22 is fastened by a high pressure to the opening of the rear end portion of the holder 12 and is deformed along the axial direction of the holder 12. Therefore, the inner side of the pipe 22 is brought into tight contact with the assembly body 21, and the outer side of the pipe 22 is brought into tight contact with the inner wall of the holder 12, thus avoiding problems caused by an external force and thermal contraction. A portion of the terminal 13 which is embedded into the insulating material is knurled.

Reference numerals 23 and 24 denote an insulating ring and a metallic washer which are engaged with the second terminal 14 extending backward from the holder 12. Reference numeral 25 denotes an insulating member engaged with the first terminal 13 at the outer side of the washer 24. Reference numerals 26 and 27 respectively denote a spring washer and a fastening nut which are threadably engaged with the screw portion formed at the outer end portion of the first terminal 13. The first and second terminals 13 and 14 are electrically connected to the battery terminal by inserting lead wires (not shown) between the washer 24 and the insulating member 25 and between the insulating member 25 and the spring washer 26.

Reference numerals 28 and 29 denote insulating tubes for covering the wires 16 and 17 (e.g., Fe), respectively.

According to the present invention, in the ceramic heater rod 11 held at the distal end of the holder 12, the ends of the respective lead portions are embedded in the the rear end portion of the ceramic heater rod 11 at equal intervals along the longitudinal direction. The exposed ends are connected to metallized layers 30 and 31. The metallized layers 30 and 31 are connected to the wires 16 and 17 through terminal caps 32 and 33, respectively.

The above construction will be described in detail with reference to FIGS. 2 and 3. According to this embodiment, an extended heater rod portion 11*a* integrally extends from part of the rear end face of the heater rod 11. The ends of the respective lead portions are embedded so as to extend at the rear end portion of the rod 11 and the distal end of the extended heater rod portion 11*a*. The metallized layers 30 and 31 electrically connected to the respective lead portion ends are formed on the outer surface of the rear end portion of the heater rod 11 and its end face portion excluding the extended heater rod portion 11*a* and on the outer surface of the front portion and end face of the extended heater rod portion 11*a*.

The terminal caps 32 and 33 cover the rear end portion of the heater rod 11 and the distal end portion of the extended heater rod portion 11*a*. The terminal caps 32 and 33 are soldered by a silver solder to the metal pipe 19 in a heating furnace. The wires 16 and 17 connected to the terminal caps 32 and 33 are bonded such that their distal flange portions are locked by the caps 32 and 33, respectively, as shown in FIG. 2.

With this construction, the terminal caps 32 and 33 having the wires 16 and 17 sequentially cover the heater rod 11 from its rear end side. The resultant structure is placed in the heating furnace, and the terminal caps 32 and 33 are soldered by silver solder to the metal pipe 19, thus simplifying the assembly operation. In addition, bonding of the respective parts is guaranteed, providing operational reliability. With the construction described above, the wires 16 and 17 can be wired within the substantially the same area as the cross section of the heater rod 11, so that the diameter of the holder 12 can be minimized, thereby providing compact construction.

The assembly comprises the heater rod 11, the terminal caps 32 and 33 which are connected to the wires 16 and 17, and the metal pipe 19 bonded to the terminal caps 32 and 33. This assembly is mounted in the holder 12 in the following manner. After the wires 16 and 17 are inserted through the insulating tubes 28 and 29, the rear ends of the wires 16 and 17 are connected by resistance welding to the rod portion 13*a* and the lead member 14*a* of the first and second terminals 13 and 14 of the terminal assembly 15 made by plastic molding. The resultant structure is inserted in the rear end portion of the holder 12 and extends from the front end thereof. The metal pipe 19 for holding the heater rod 11 at the front end of the holder 12 is locally heated and bonded to the front end of the holder 12. The portion of the holder 12 which is in the vicinity of the rear end opening thereof is caulked to lock the terminal assembly 15 therein.

When fixing the metal pipe 19 on the holder 12, a welding material must comprise a low refractory metal having a melting point lower than the silver solder used in welding the metal pipe 19 and the heater rod 11 so as not to thermally influence the bonding portion between the heater rod 11 and the metal pipe 19 and hence avoid leakage at the bonding portion. For this reason, in this embodiment, a low refractory metal material such as an alloy of silver, cadmium and tin or an alloy of silver, zinc and tin is used as the welding material. Such an alloy has a melting point lower than that of the silver solder. The portions subjected to welding are locally heated with an RF power and are welded with each other. Therefore, the resin-molded body 21 of the terminal assembly 15 held at the rear end portion of the holder 12 will not be thermally influenced, thereby guaranteeing reliability and durability of the respective components.

In the preferred embodiment shown in FIG. 1, a distance between the terminal caps at the same end was 5 mm. An outer diameter of the holder 12 was 10 mm, and its inner diameter was 6 mm. Also, an outer diameter of the cap covering the rear end of the heater rod 11 was 5 mm.

Figure 4:
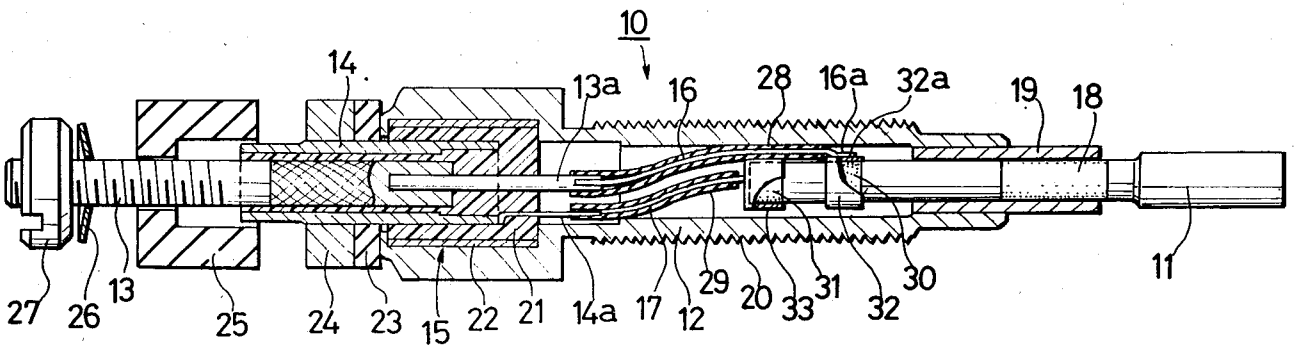
FIGS. 4 to 6 are respectively longitudinal sectional views showing a diesel engine glow plug according to another embodiment of the present invention.
Figure 5:
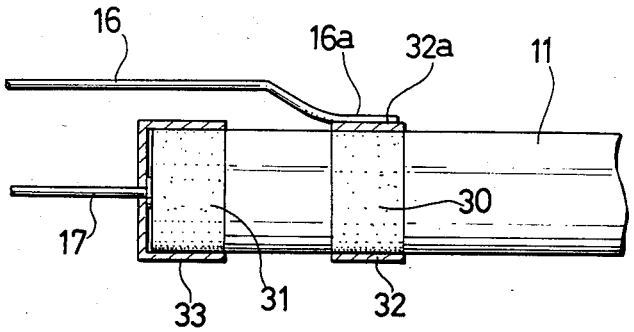
Figure 6:
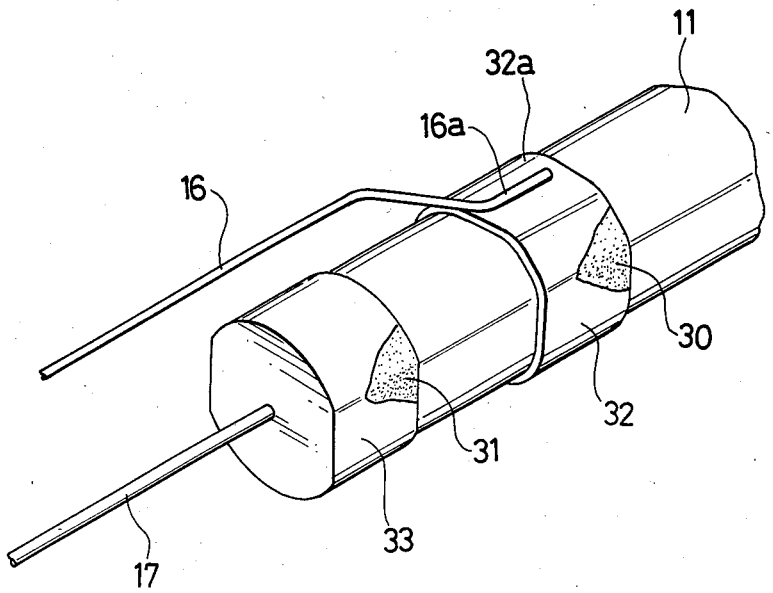
Figure 7:
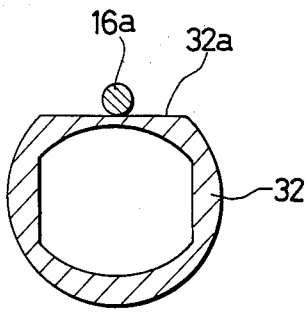
FIG. 7 is a cross-sectional view showing a modification of the glow plug shown in FIGS. 4 to 6.

The present invention is not limited to the particular embodiment described above. Various changes and modifications in shape and construction of the respective components may be made within the spirit and scope of the invention. For example, as shown in FIGS. 4 to 6, the heat rod 11 may have a straight shape, and a terminal ring 32 and a terminal cap 33 may be mounted at the rear end side of the heater rod 11 at a predetermined interval. In this case, the terminal ring 32 and the terminal cap 33 may be bonded to the lead portion ends in the heater rod 11, respectively. The front side terminal ring 32 is bonded to the wire 16 in such a manner that the end portion 16*a* of the wire 16 is bonded by resistance welding or the like to the welding portion 32*a* of the ring 32. In this case, an outer diameter of the holder 12 was 20 mm, and its inner diameter was 15 mm. An outer diameter of the cap was 5 mm. In a modification shown in FIG. 7, an end 16*a* of a wire 16 may be welded to a flat welding portion 32*a* in the terminal ring 32 which has a hole formed in the inner surface that aligns with the cross section of the heater rod 11. The outer surface of the terminal ring 32 has a circular shape.

According to the diesel engine glow plug as described above, a ceramic heater rod is used, and a pair of lead portions are connected to two ends of the resistor embedded in the heater rod and are exposed at rear end positions spaced by a predetermined distance along the longitudinal direction of the heat rod. The terminal caps connected to the respective terminals of the terminal assembly held in the rear end portion of the holder through the wires are fitted on the exposed portions, respectively. Therefore, a simple glow plug can be obtained in accordance with simple molding and simple assembly. The diameter of the glow plug is small and the cost is low. Other advantages are also provided.

In the above embodiment, the insulator-covered wire is used. However, an insulator-coated wire may be used in place of the insulator-covered wire.

What is claimed is:

1. A diesel engine glow plug comprising:

a heater rod which has a resistor embedded therein and which is made of a ceramic;

a metal holder for holding said heater rod at a front end thereof; and a terminal assembly having first and second external connecting terminals which are held at a rear end portion of said holder and which are electrically insulated from each other, said rear end portion of said heater rod being provided with a pair of lead portions which are spaced apart by a predetermined distance from each other along a longitudinal direction of said heater rod and which are connected to two ends of said resistor, said lead portions being covered with terminal caps, respectively;

each of said terminal caps being connected to one end of a flexible insulator-covered wire the other end of which is connected to a corresponding one of said first and second external connecting terminals;

said second external connecting terminal being hollow;

said first external connecting terminal being housed in said second external connecting terminal through an insulating material;

said second external connecting terminal being housed in the rear end portion of said holder through an insulating bush; and said insulating bush being constituted by a metal pipe connected to said rear end portion of said holder and an insulating material inserted between said metal pipe and said second external connecting terminal;

whereby said metal pipe is subjected to an external force acting on said rear end portion of said holder so as to press said insulating materials on said first and second terminal connecting terminals in an air-tight manner.

2. A glow plug according to claim 1, wherein a portion of said first external connecting terminal which is embedded in the corresponding insulating material is knurled.

3. A glow plug according to claim 1, wherein a rod connected to one of said insulator-covered wires extends from a lower end of said first external connecting terminal.

4. A glow plug according to claim 3, wherein a lead member connected to the other of said insulator-covered wires extends from a lower end of said second external connecting terminal.

5. A glow plug according to claim 1, wherein one of said terminal caps is mounted on said rear end portion of said heater rod, and the other thereof is spaced by a predetermined distance from said rear end portion of said heater rod in a forward direction.

6. A glow plug according to claim 1, wherein one of said terminal caps is mounted on said rear end portion of said heater rod, and the other thereof is spaced by a predetermined distance from said rear end portion of said heater rod toward a direction of said terminal assembly, said terminal caps having a small-diameter heater extended portion therebetween.

* * * * *